United States Patent [19]

Gat et al.

[11] Patent Number: 4,680,451

[45] Date of Patent: Jul. 14, 1987

[54] APPARATUS USING HIGH INTENSITY CW LAMPS FOR IMPROVED HEAT TREATING OF SEMICONDUCTOR WAFERS

[75] Inventors: Anita S. Gat; Eugene R. Westerberg, both of Palo Alto, Calif.

[73] Assignee: A. G. Associates, Sunnyvale, Calif.

[21] Appl. No.: 760,160

[22] Filed: Jul. 29, 1985

[51] Int. Cl.[4] ..... F27B 5/14; H05B 1/02

[52] U.S. Cl. ..... 219/411; 219/405; 118/50.1; 118/725

[58] Field of Search ..... 219/405, 411, 354, 85 BA, 219/85 BM; 118/724, 725, 729, 730, 50.1

[56] References Cited

U.S. PATENT DOCUMENTS

| | | | |
|---|---|---|---|
| 3,240,915 | 3/1966 | Carter | 219/405 |
| 3,836,751 | 9/1974 | Anderson | 219/405 |
| 4,540,876 | 9/1985 | McGinty | 219/411 |
| 4,558,660 | 12/1985 | Nishizawa | 219/411 |

FOREIGN PATENT DOCUMENTS

| | | | |
|---|---|---|---|
| 59-52835 | 3/1984 | Japan | 118/50.1 |

OTHER PUBLICATIONS

G. E. Brochure, "Infrared Heating for People and Products", Aug. 1973.

*Primary Examiner*—E. A. Goldberg
*Assistant Examiner*—Teresa J. Walberg
*Attorney, Agent, or Firm*—Flehr, Hohbach, Test, Albritton & Herbert

[57] ABSTRACT

Radiation heating of a semiconductor wafer employs first and second pluralities of spaced and skewed lamps. Lamps in each plurality are grouped beginning with the innermost lamps and extending to the outermost lamps. Each group of lamps in one plurality of lamps are interconnected with a group of lamps in the other plurality of lamps whereby the interconnected groups of lamps are simultaneously and equally energized. Lamp voltage is modulated in accordance with a preestablished table for each size of wafer and temperature cycle. Alternatively, temperature sensors can be employed to provide feedback to a computer controlled modulator. The lamps in the different groups can be selected to have different steady state power intensities for a given voltage to thereby establish a desired temperature gradient.

22 Claims, 5 Drawing Figures

APPARATUS USING HIGH INTENSITY CW LAMPS FOR IMPROVED HEAT TREATING OF SEMICONDUCTOR WAFERS

This invention relates generally to apparatus for heat treating semiconductor material, and more particularly the invention relates to heat treating of semiconductor wafers with improved uniformity and minimal slippage using high intensity CW lamps.

High intensity lamp heaters are now available for heat treating of semiconductor wafers. For example, the Heat-pulse TM system manufactured and sold by A.G. Associates, Palto Alto, Calif. permits fast ramping of temperatures at 1100° C. and the maintenance of this temperature for a period of 10 seconds or so for the rapid annealing of ion implanted semiconductor wafers. The temperature is then quickly lowered thereby minimizing the movement of dopant ions in the crystal lattice structure. The same apparatus could be used for phosphorous doped oxide reflow, metal silicide formation, annealing, and other semiconductor applications.

When heat treating semiconductor wafers at a temperature of 1100° C. or above, uniformity of heating is important to prevent thermally induced stresses and resulting slippage in the crystal structure. Heretofore, banks of lamps above and below the wafer all aligned in parallel have been used to heat the wafers. The current in each lamp is controlled to try and maintain some uniformity of temperature within the apparatus. However, maintenance of uniform temperature has not been possible due to the reradiated heat near the edges of the wafer, thus leading to a temperature gradient near the edges of the wafer. Attempts at overcoming this problem have included use of a supplementary lamp with generally circular configuration which surrounds the wafer in close proximity to the wafer edges. In addition to the increased complexity of the lamp heating array, an obvious limitation of using the supplementary lamp is the restriction of the lamp to one diameter size of wafer. However, in actual practice wafers of varying diameters, from 3 inches to 6 inches must be accommodated.

Accordingly, an object of the present invention is an improved apparatus for radiation heating of semiconductor wafers.

Another object of the invention is a high temperature lamp heater which is readily controlled in heating wafers of various diameters.

A feature of the invention is a high temperature lamp array which is configured for heating semiconductor wafers of various sizes and which minimizes a temperature gradient along the wafer edges.

Briefly, the invention includes use of two banks of high intensity lamps for heating a wafer therebetween. Each bank has a plurality of lamps, and the lamps of one bank are skewed with respect to the lamps of the other bank. Preferably, each bank of lamps are parallel and the two banks of lamps are orthogonally arranged.

To maintain a generally uniform temperature across a wafer of any size, the lamps are energized independently in groups of two or more with a group in one bank being interconnected for energization with a group in the other bank whereby the two groups of lamps can be simultaneously and equally energized. All of the lamps are so connected to provide a plurality of heating zones extending outwardly. Since the groups of lamps are independently controlled, heat near the edge of a wafer can be increased to minimize temperature gradients in the wafer.

The electrical power to the lamps can be controlled in accordance with preestablished lamp current for obtaining a desired temperature for a specific size of wafer. Alternatively, sensors can be provided to sense the temperature of the heated wafer and provide feedback for automatically controlling the lamp groups. Additionally, a desired temperature gradient profile can be established by adjusting the relative power of the groups of lamps through judicious selection of the individual lamps as to power rating.

The invention and objects and features thereof can be more readily understood from the following detailed description and appended claims when taken with the drawing, in which:

Figure 1:
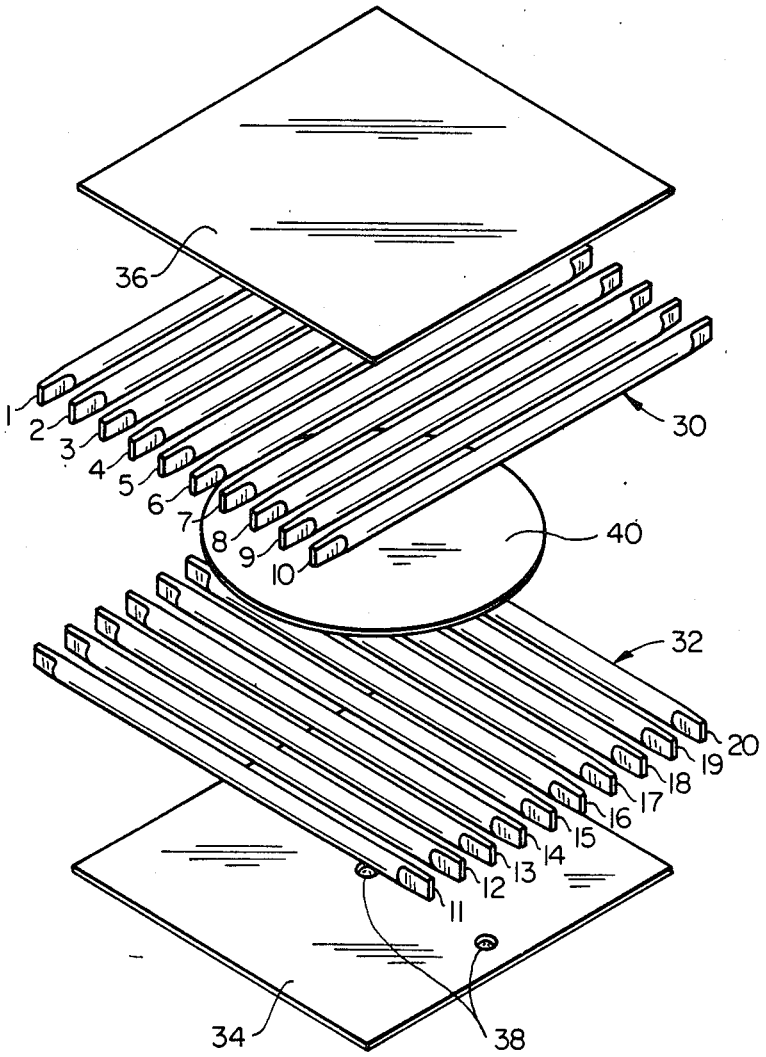
FIG. 1 is an exploded perspective view of heating apparatus in accordance with one embodiment of the invention.

Referring now to the drawings, FIG. 1 is an exploded perspective view of one embodiment of heating apparatus in accordance with the invention. A first plurality of lamps shown generally at 30 and numbered 1–10 are provided above a wafer position, and a second plurality of lamps shown generally at 32 and numbered 11–20 are provided below the wafer position. The lamps may be conventional tungsten halogen lamps. A light reflector 34 is positioned below the bank of lamps 32, and a light reflector 36 is positioned above the bank of lamps 30. Two temperature sensors 38 are supportably positioned in reflector 34 for sensing the temperature of a heated wafer. Suitable sensor can be optical pyrometer thermometers manufactured and sold by I. R. Con, Inc. of Skokie, Ill.

Figure 2:
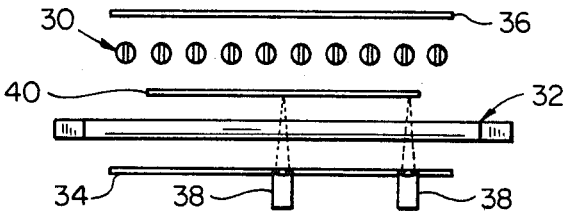
FIG. 2 is a side view of the heating apparatus of FIG. 1 illustrating a wafer therein.

FIG. 2 is a side view of the apparatus of FIG. 1 and further illustrates the positioning of a wafer 40 between the lamp banks 30 and 32. One of the sensors 38 is positioned beneath the center of the wafer 40 and the other sensor 38 is positioned near the edge of wafer 40.

Figure 3:
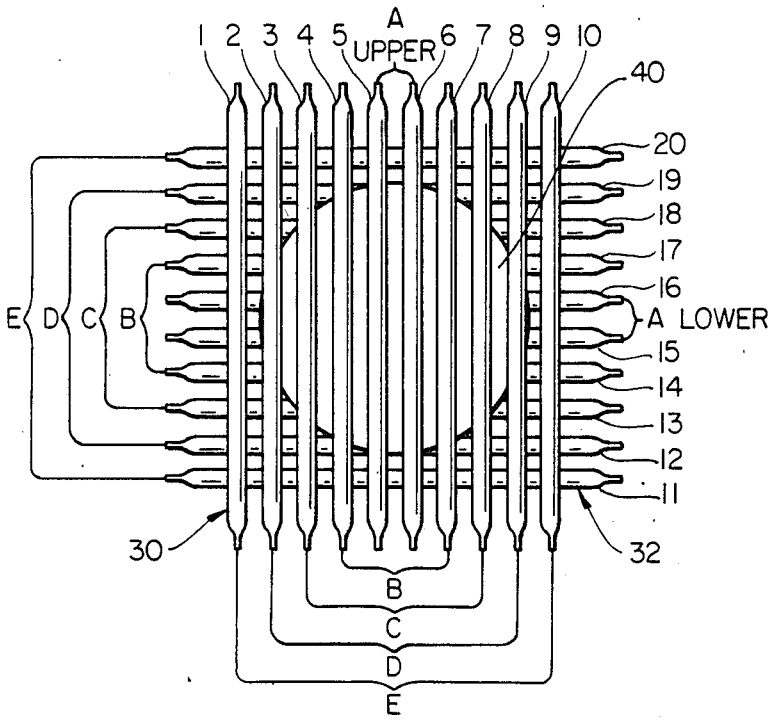
FIG. 3 is a top schematic view of the two banks of lamps illustrating the positioning of a wafer therebetween and the energization of the lamps in pairs.
Figure 4:
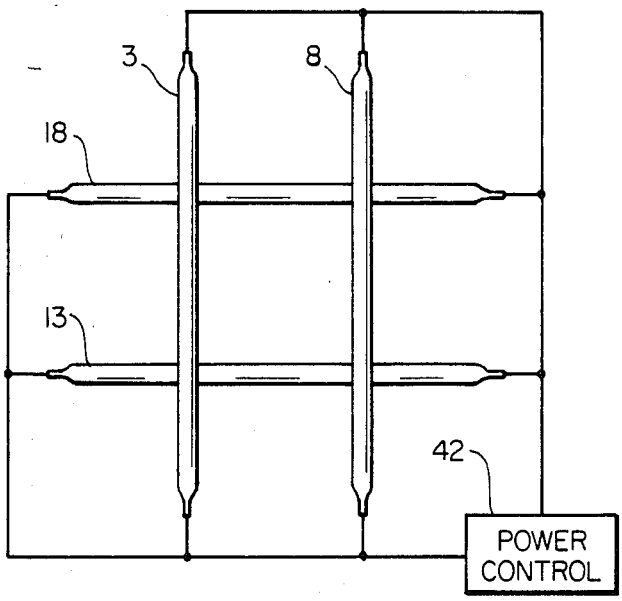
FIG. 4 is a schematic diagram illustrating the energization of two pairs of lamps of the array of FIG. 2.

FIG. 3 is a top plan view of the two banks of lamps with the wafer 40 positioned therebetween and in alignment with the criss-cross pattern of the lamps. As shown in this illustration, the lamps in each bank are paired beginning with the outermost lamps 1, 10 and 11, 20 and working inwardly to the innnermost pair of lamps 5, 6 and 15, 16. Corresponding pairs of lamps in the two banks are then connected together preferably in parallel for simultaneous and equal energization. For example, as shown in FIG. 3 the two lamps 3, 8 in the top bank of lamps are connected with the corresponding pair of lamps 13, 18 of the bottom bank of lamps with the four lamps being connected in parallel for simultaneous energization by power control unit 42.

In one mode of operation, power through the lamps is controlled by phase modulating a voltage having a constant peak amplitude, or controlling the duty cycle thereof. The voltage applied to the pairs of lamps can be preestablished for each size wafer and for a particular heat treatment. For example, heat treating of a four inch wafer where the temperature is ramped up to 700° C. in three seconds, maintained in a steady state for ten seconds, and then ramped down in three seconds can be in accordance with the following table:

RAMP TABLE

| | Normalized intensity = 1 = 30% peak | | | | |
|---|---|---|---|---|---|
| | | | 3 sec. Ramp Down | | |
| Group | 3 sec. Ramp Up | 10 sec. Steady Rate | 1 sec. | 2 sec. | 3 sec. |
| 1 | 1 | .80 | .7 | .4 | 0 |
| 2 | 1.1 | .80 | .7 | .4 | 0 |
| 3 | 1.2 | .85 | .75 | .43 | 0 |
| 4 | 1.3 | .90 | .8 | .45 | 0 |
| 5 | 1.5 | 1.0 | .9 | .50 | 0 |

This open loop system using predetermined current for the lamps may provide an annealing temperature of 700° C. plus or minus 7° C. for the ten second steady state. For other sized wafers and for other temperature annealing patterns the normalized current intensity will vary.

Figure 5:
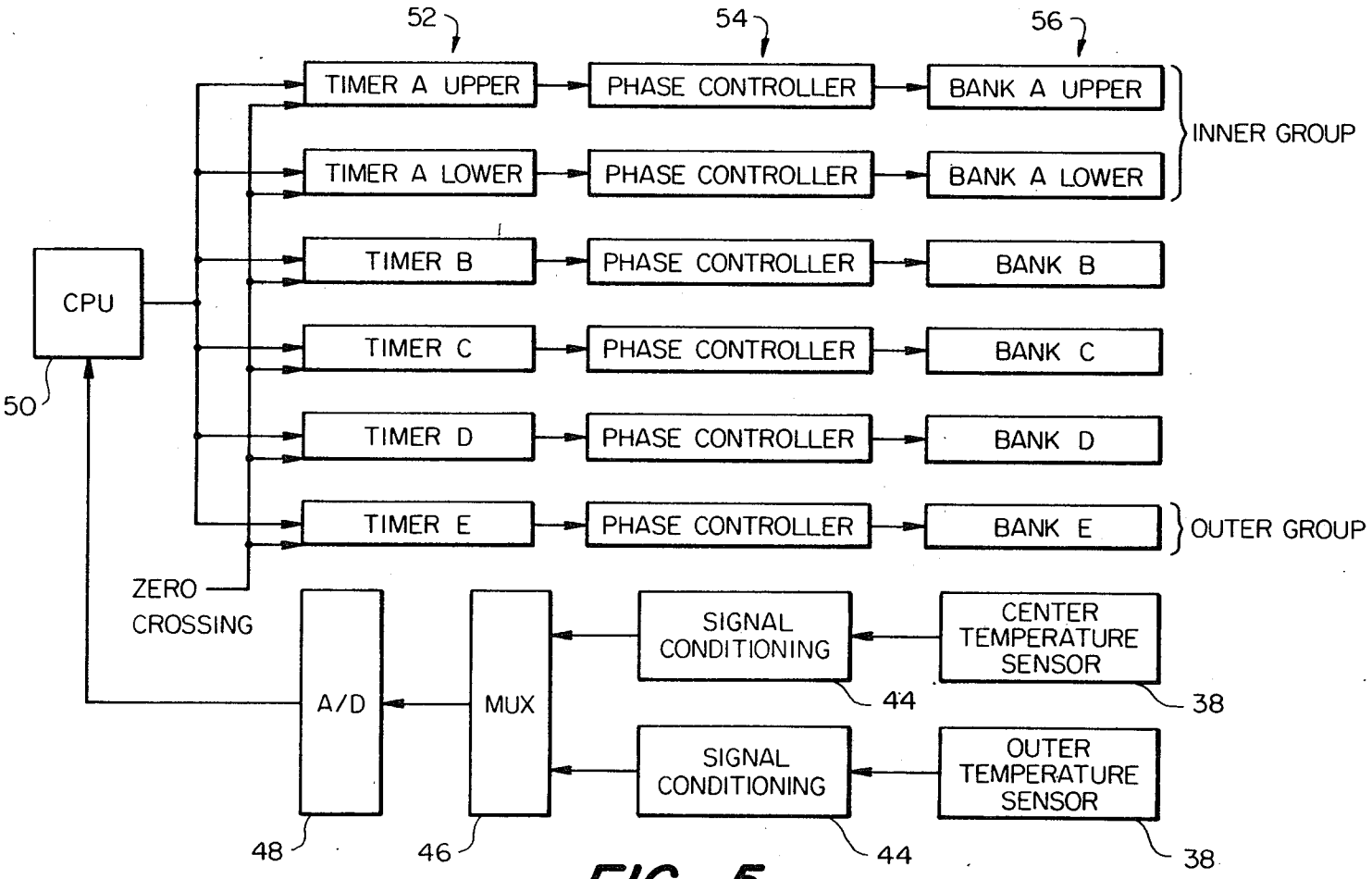
FIG. 5 is a functional block diagram of control circuitry for controlling the banks of lamps in accordance with one embodiment of the invention.

In accordance with another embodiment of the invention the temperature sensors 38 shown in FIG. 2 can provide a feedback for computer control of the lamp currents. FIG. 5 is a functional block diagram of control apparatus in which the sensors are employed. Signals from the temperature sensors 38 are suitably conditioned at 44 and applied through a multiplexer 46 to an analog to digital converter 48. The digital signals from converter 48 are then applied to a microprocessor 50 which is suitably programmed to respond to the sensed temperature and control timers 52 and phase controllers 54 in energizing the banks of lamps 56. This closed system employing the current sensors can more readily vary the temperature profiles used in heat treating a wafer. Greater control can be realized by employing more than two temperature sensors.

In alternative modes of operation, a single center sensor can be employed for dynamically controlling the central group of lamps. The other groups of lamps can have a predetermined offset from the intensity of the central groups with the other groups automatically changing as the central group is changed in intensity.

Using the two sensors, the central sensor can control the central group of lamps, while the temperature differential between the two sensors controls the offset of the outer groups of lamps.

In another mode of operation, the groups of lamps can have different steady state intensities for a given voltage thereby establishing a desired temperature gradient. Each wafer size can be provided with a specific gradient which is not dependent on electronic control.

Heating apparatus utilizing high intensity CW lamps in accordance with the invention provide more accurate control of the temperature in a wafer and maintain desired temperature gradients therein. Use of the temperature sensors and feedback provides greater versatility in controlling the temperature profiles in heat treating a wafer, and the proper selection of lamps can provide a desired temperature gradient without need for electronic control. While the invention has been decribed with reference to a specific embodiment, the description is illustrative of the invention and is not to be construed as limiting the invention. Various modifications and applications may occur to those skilled in the art without departing from the true spirit and scope of the invention as defined by the appended claims.

What is claimed is:

1. Apparatus for heating semiconductor wafers of various diameters and establishing desired radial temperature gradients comprising a first plurality of parallel lamps, a second plurality of parallel lamps, said second plurality of lamps being spaced from and skewed with respect to said first plurality of lamps whereby a semiconductor wafer can be positioned therebetween, means electrically connecting pairs of lamps in said first plurality of lamps beginning with innermost lamps and extending outwardly and means electrically connecting pairs of lamps in said second plurality of lamps, beginning with innermost lamps and extending outwardly, and means electrically interconnecting each pair of electrically connected lamps in said first plurality of lamps with a pair of electrically connected lamps in said second plurality of lamps whereby the interconnected pairs of lamps are simultaneously and equally energized to establish desired temperature gradients.

2. Apparatus as defined in claim 1 wherein lamps in each connected pair of lamps are connected in parallel.

3. Apparatus as defined in claim 2 wherein lamps in each interconnected pairs of lamps are connected in parallel.

4. Apparatus as defined by claim 3 and further including control means for controlling power to the interconnected pairs of lamps whereby a desired variable temperature gradient can be maintained when heating wafers of various diameters between said first plurality of lamps and said second plurality of lamps and preventing crystal lattice slippage in said wafers.

5. Apparatus as defined by claim 4 wherein said control means includes a voltage source and modulation means for modulating the duty cycle of voltage applied through interconnected pairs of lamps.

6. Apparatus as defined in claim 5 wherein said modulation means is controlled in accordance with preestablished duty cycles of current through said interconnected pairs of lamps.

7. Apparatus as defined in claim 5 and further including temperature sensing means for sensing temperature of a wafer, and computer control means responsive to the sensed temperature for controlling said modulation means.

8. Apparatus as defined by claim 7 wherein said sensing means includes two sensors, and further including control means for controlling power in response to the temperature gradient between said two sensors.

9. Apparatus as defined in claim 1 and further including control means for controlling power to the interconnected pairs of lamps whereby a desired temperature can be maintained when heating a wafer between said first plurality of lamps and said second plurality of lamps.

10. Apparatus as defined by claim 9 wherein said control means includes a voltage source and modulation means for modulating the duty cycle of voltage applied to interconnected pairs of lamps.

11. Apparatus as defined by claim 10 wherein said modulation means is controlled in accordance with preestablished duty cycles of voltage applied to said interconnected pairs of lamps.

12. Apparatus as defined in claim 10 and further including temperature sensing means for sensing temperature of a wafer, and computer control means responsive to the sensed temperature for controlling said modulation means.

13. Apparatus as defined by claim 1 wherein lamps in said pairs of lamps are selected to have different steady state power intensities for a given voltage to thereby establish a desired temperature gradient.

14. Apparatus for heating semiconductor wafers of various sizes according to desired radial temperature gradient comprising a first plurality of lamps, a second plurality of lamps, said second plurality of lamps being spaced from and skewed with respect to said first plurality of lamps whereby a semiconductor wafer can be positioned therebetween, means electrically connecting groups of lamps in said first plurality of lamps and means electrically connecting groups of lamps in said second plurality of lamps, lamps in each plurality of lamps being grouped beginning with innermost lamps and extending to outermost lamps, and means electrically interconnecting each group of lamps in said first plurality of lamps with a group of lamps in said second plurality of lamps whereby the lamps in the interconnected groups of lamps are simultaneously and equally energized.

15. Apparatus as defined by claim 14 wherein each group of lamps includes at least two lamps.

16. Apparatus as defined by claim 15 wherein said lamps in each plurality of lamps are aligned in parallel.

17. Apparatus as defined by claim 14 and further including control means for controlling power to the interconnected groups of lamps whereby a desired variable temperature gradient can be maintained when heating a wafer between said first plurality of lamps and said second plurality of lamps.

18. Apparatus as defined by claim 17 wherein said control means includes a voltage source and modulation means for modulating the duty cycle of voltage applied to interconnected pairs of lamps.

19. Apparatus as defined by claim 18 wherein said modulation means is controlled in accordance with preestablished duty cycles of voltage applied to said interconnected pairs of lamps.

20. Apparatus as defined by claim 18 and further including temperature sensing means for sensing temperature of a wafer, and computer control means responsive to the sensed temperature for controlling said modulation means.

21. Apparatus as defined by claim 20 wherein said temperature-sensing means includes two sensors, said computer control means being responsive to the temperature gradient between said two sensors.

22. Apparatus as defined by claim 14 wherein lamps in said groups of lamps are selected to have different steady state power intensities for a given voltage to thereby establish a desired temperature gradient.

* * * * *